US012054321B2

(12) United States Patent
Senn

(10) Patent No.: US 12,054,321 B2
(45) Date of Patent: Aug. 6, 2024

(54) PROTECTIVE INSERT FOR BASILOID PACKAGE

(71) Applicant: Sonoco Development, Inc., Hartsville, SC (US)

(72) Inventor: Jonathan E. Senn, Nashville, TN (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 17/946,128

(22) Filed: Sep. 16, 2022

(65) Prior Publication Data

US 2024/0092527 A1 Mar. 21, 2024

(51) Int. Cl.
*B65D 5/42* (2006.01)
*B65D 85/68* (2006.01)

(52) U.S. Cl.
CPC ..... *B65D 5/4208* (2013.01); *B65D 85/68* (2013.01)

(58) Field of Classification Search
CPC ..... B65D 5/42; B65D 5/4208; B65D 5/4266; B65D 85/68
USPC ..... 206/320, 586
See application file for complete search history.

(56) References Cited

U.S. PATENT DOCUMENTS 2,250,491 A * 7/1941 Lurrain ..... A47G 1/06 206/586
3,613,985 A * 10/1971 Goodsite ..... B65D 81/054 206/586
3,982,682 A * 9/1976 Fremion ..... B65D 5/5033 206/586
4,804,138 A 2/1989 McFarland
5,131,541 A 7/1992 Liebel
5,398,808 A * 3/1995 Chen ..... B65D 5/5071 206/320
6,155,419 A 12/2000 Sowa
6,578,346 B1 6/2003 Sowa
2003/0155272 A1* 8/2003 Ragsdale ..... B65D 5/5069 206/586
2006/0186017 A1 8/2006 Markert et al.
2008/0083821 A1 4/2008 Marventano
2008/0197033 A1* 8/2008 Russo ..... B65D 85/48 206/325

FOREIGN PATENT DOCUMENTS

CN 110871952 A 3/2020
WO 02081311 A2 10/2002

OTHER PUBLICATIONS

International Search Report related to Application No. PCT/US2023/031399; reported on Nov. 28, 2023.

* cited by examiner

*Primary Examiner* — Bryon P Gehman
(74) *Attorney, Agent, or Firm* — von Briesen & Roper, s.c.

(57) ABSTRACT

A packaging assembly for housing an appliance comprises a top cap, a carton and a spacer affixed to the top cap and carton. The top cap and carton form a basiloid lifting flange. The spacer spaces the appliance from the carton sidewall on the basiloid lifting side and enhances the structural strength of the lifting flange.

18 Claims, 7 Drawing Sheets

PROTECTIVE INSERT FOR BASILOID PACKAGE

BACKGROUND OF THE INVENTION

Field of the Invention

This disclosure relates to packaging for large appliances. More particularly, this patent relates to a protective insert for use with basiloid packaging for large appliances.

Description of the Related Art

This disclosure relates in part to basiloid type packaging. The principle of the basiloid method is to replace lift truck forks with an adjustable positioning lifting (basiloid) blade that slips under the lip of a folded cap carton. The lifting blade rides up and down on the fork carriage. It lifts the carton by the top lip instead of sliding forks under the carton. This lifting exerts pressure on the package, especially near the top lifting flange, which can require reinforcing the package near the lifting flange.

The present disclosure is designed to solve the problems described above.

BRIEF SUMMARY OF THE INVENTION

The present disclosure relates to a packaging assembly for housing an appliance.

In one aspect the packaging assembly comprises a top cap, a carton and a spacer affixed to the top cap and carton. The top cap and carton form a basiloid lifting flange. The spacer spaces the appliance from the carton sidewall on the basiloid lifting side and enhances the structural strength of the lifting flange.

The top cap has a top or covering panel and comprises a top or covering panel, an outer flap and an inner flap. The outer flap and the inner flap form part of a basiloid lifting flange. The outer flap extends downward from the top panel and terminates in a double fold line. The inner flap extends upwardly from the double fold line. The outer flap and the inner flap define a first slot having an open, top panel facing end.

The carton comprises four sidewalls foldably attached along vertical fold lines to form a rectilinear sleeve-like structure. Each sidewall has a top edge. The carton further comprises a top flap extending downward from the top edge of at least one sidewall. The top flap extending into the first slot and together with the outer flap and inner flap forms the basiloid lifting flange. The sidewall and the top flap define a second slot having an open lower end for receiving the inner flap.

The spacer separates the appliance from the carton sidewall and enhances the structural strength of the lifting flange. The spacer is vertically oriented and comprises opposing horizontal ends, a substantially planar outer leg panel extending upward from a first free edge to an upper edge, a top panel oriented orthogonally to the outer leg panel and extending from the upper edge to a second upper edge, an angled panel defining an obtuse included angle with the top panel and extending from the second upper edge to an inner edge, an appliance facing panel extending vertically downward from the inner edge to a second inner edge, a lower horizontal panel extending horizontally outward (away from the appliance) from the second inner edge to the sidewall, and an inner leg panel extending vertically downward from the lower horizontal panel to a second free edge.

The outer leg panel and the inner leg panel are in a generally parallel spaced relation to each other and form an open lower end for receiving the top flap, the inner flap and the carton sidewall. The second slot is configured to receive the blade of a basiloid lift truck to facilitate lifting and moving of the packaging assembly.

In a second aspect the packaging assembly comprises a top cap, a carton and an alternative spacer affixed to the top cap and carton. The top cap and carton form a basiloid lifting flange and may be substantially similar to the top cap and carton of the previous embodiment.

The second, or alternative, spacer separates the appliance from the carton sidewall and enhances the structural strength of the lifting flange. The second spacer is vertically oriented and comprises opposing horizontal ends, a substantially planar outer leg panel extending upward from the first elongated free edge to an upper edge, a top panel oriented orthogonally to the outer leg panel and extending from the upper edge to a second upper edge, an appliance facing panel extending vertically downward from the second upper edge to an inner edge, a lower horizontal panel extending horizontally outward from the inner edge to a third edge adjacent the sidewall, and an inner leg panel extending vertically downward from the lower horizontal panel to a second free edge. The outer leg panel and the inner leg panel are in generally parallel spaced relation to each other to form an open lower slot for receiving the carton.

As in the first embodiment, the outer leg panel and the inner leg panel are in a generally parallel spaced relation to each other and form an open lower end for receiving the top flap, the inner flap and the carton sidewall. The second slot is configured to receive the blade of a basiloid lift truck to facilitate lifting and moving of the packaging assembly.

DETAILED DESCRIPTION OF THE INVENTION

Figure 1:
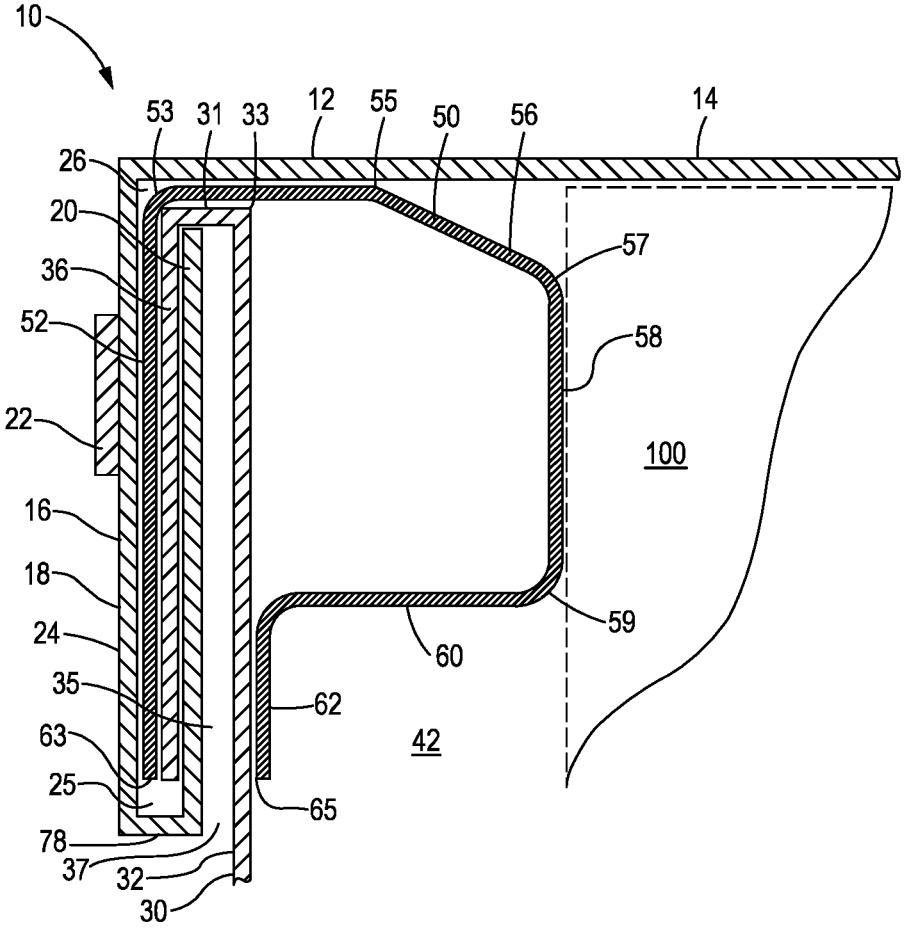
FIG. 1 is a partial cross-sectional view of a packaging assembly for housing an appliance or other item.

While the invention described herein may be embodied in many forms, there is shown in the drawings and will herein be described in detail one or more embodiments with the understanding that this disclosure is to be considered an exemplification of the principles of the invention and is not intended to limit the disclosure to the illustrated embodiments. Aspects of the different embodiments can be combined with or substituted for one another.

As will be appreciated, terms such as "upper" and "lower", "top" and "bottom," "horizontal" and "vertical"

(etc.), used as nouns, adjectives or adverbs refer in this description to the orientation of the structure of the packaging assembly as it is illustrated in the various views. Such terms are not intended to limit the invention to a particular orientation.

Turning to the drawings, where like numerals indicate like elements, there is shown in FIG. 1 a partial cross-sectional view of a first embodiment of a packaging assembly 10 for housing an appliance 100 or other item. The packaging assembly 10 comprises a top cap 12, a carton 30 and a spacer 50.

The top cap 12 fits over the carton 30 and comprises a top (covering) panel 14 and four downwardly extending side flaps 24. At least one of the side flaps 24 also functions as a (basiloid) lifting flange 16. The lifting flange 16 comprises an outer flap 18 extending downwardly from the top panel 14 and an inner flap 20 extending upwardly from the outer flap 18. The outer flap 18 and the inner flap 20 define a first slot 25 having an open, top panel facing, upper end 26, the purpose of which is explain below.

The carton 30 has four sidewalls 32 defining a top edge 33 and a bottom edge 99. Each sidewall 32 is foldably attached to one or two other sidewalls 32 along vertical fold lines 34 to form a rectilinear sleeve-like structure. A short glue flap 38 (shown in FIG. 5) may extend from one of the sidewalls 32 to underlie the edge of another sidewall 32 to which it is glued to hold the carton 30 in the closed position. The carton may also have a small bottom flap 39 foldably attached to each sidewall 32 along the bottom edge 99. Optionally, the bottom end of the carton 30 may be fitted with a bottom cap (not shown). A top flap 36 extends downward from the top edge 33 of at least one sidewall 32. The top flap 36 is connected to the top edge 33 by a relatively short top lip 31. The top flap 36 extends downward into the first slot 25.

Figure 3:
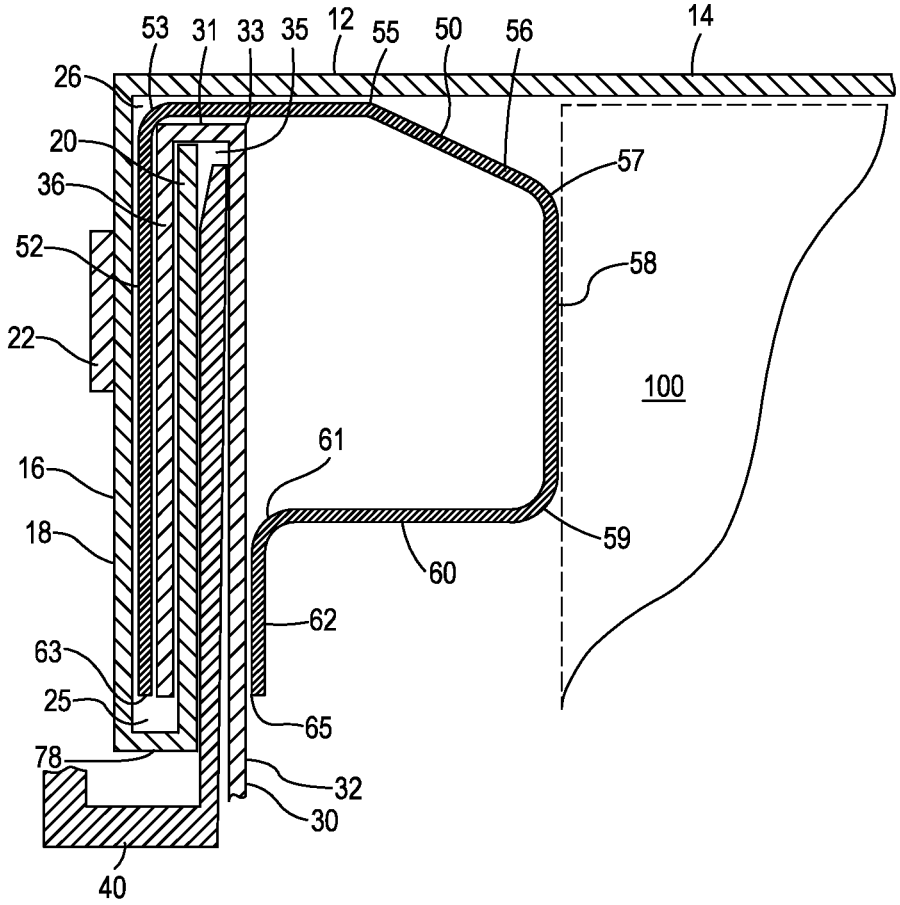
FIG. 3 is partial cross-sectional view of the packaging assembly of FIG. 1 shown with a basiloid blade.

The sidewall 32 and the top flap 36 define a second slot 35 having an open lower end 37 for receiving the top cap inner flap 20. As best shown in FIG. 3, the top cap inner flap 20 and the carton sidewall 32 are flexible enough or the second slot 35 is wide enough to also accommodate a basiloid blade 40. More particularly, a basiloid blade 40 can be inserted into the second slot 35 between the top cap inner flap 20 and the carton sidewall 32.

The spacer 50 is frictionally attached to the carton 30 and is at least partially located within the carton interior 42 to space the appliance 100 from the inside of a carton wall 32 to cushion and protect the appliance 100 during basiloid handling, especially near the top of the packaging assembly 10. The spacer 50 comprises a substantially planar outer leg panel 52 extending upward from a first free edge 63 to an upper edge 53, a top panel 54 oriented orthogonally to the outer leg panel 52 and extending from the upper edge 53 to a second upper edge 55, an angled panel 56 defining an obtuse included angle with the top panel 54 and extending from the second upper edge 55 to an inner edge 57, an appliance facing panel 58 extending vertically downward from the inner edge 57 to a second inner edge 59, a lower horizontal panel 60 extending horizontally outward (away from the appliance) from the second inner edge 59 to the sidewall 32, and an inner leg panel 62 extending vertically downward from the lower horizontal panel 60 to a second free edge 64. The outer leg panel 52 and the inner leg panel 62 are in generally parallel spaced relation to each other to form an open lower slot 66 for receiving the carton 30.

Figure 2:
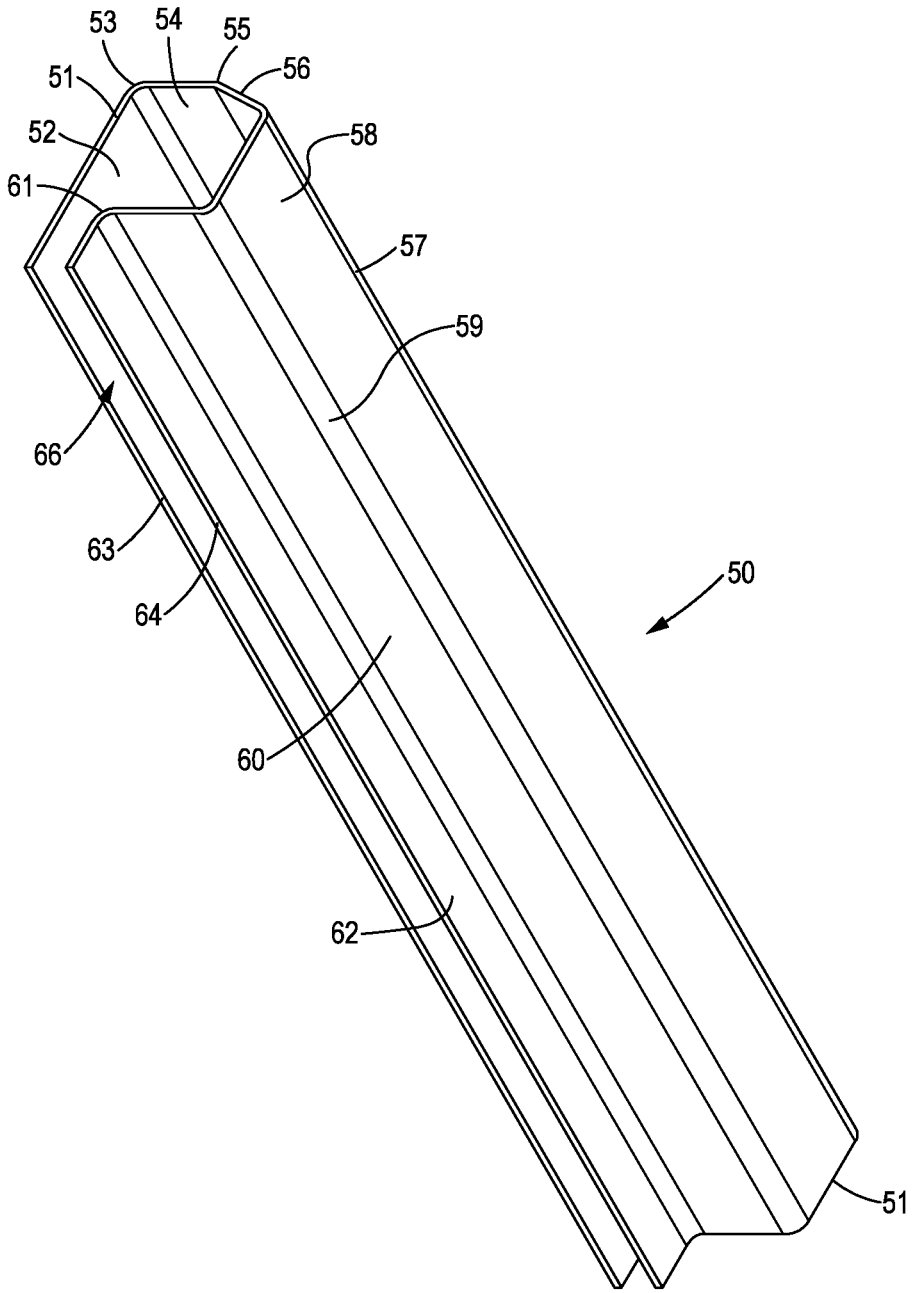
FIG. 2 is a perspective view of a spacer used as a component of the packaging assembly of FIG. 1.

As perhaps best shown in FIG. 2, the spacer 50 is an elongated, open structure having opposing horizontal ends 51, an elongated first free edge 63 and an elongated second free edge 64. The spacer 50 may be made from a rectangular sheet of material such as paperboard that has been folded or otherwise shaped into a modified "P" shape (in its transverse cross-sectional profile) that enables the spacer 50 to fit snugly over the carton 30 and part of the top cap 12 to separate the appliance 100 and the carton 30. The cross sectional "P" shape profile also enhances the structural strength of the packaging assembly 10.

The spacer 50 may be substantially rigid, especially in the longitudinal (end 51 to end 51) direction, yet resiliently flexible in the transverse direction (defined as the direction orthogonal to the longitudinal direction), at least prior to installation, partly due to the fact that the spacer 50 is open along lower slot 66. When installed, the spacer 50 maintains a gap between the appliance 100 and the carton sidewall 32 a distance approximately equal to the length of the lower horizontal panel 60.

FIG. 3 is partial cross-sectional view of the packaging assembly 10 of FIG. 1 shown with a basiloid blade 40. To lift the packaging assembly 10, the basiloid blade 40 is inserted into the second slot 35 defined by the lifting flange 16 and the carton wall 32. Preferably the tip of the blade 40 does not extend the entire height of the second slot 35, and this does not contact the underside of the top lip 31.

Figure 4:
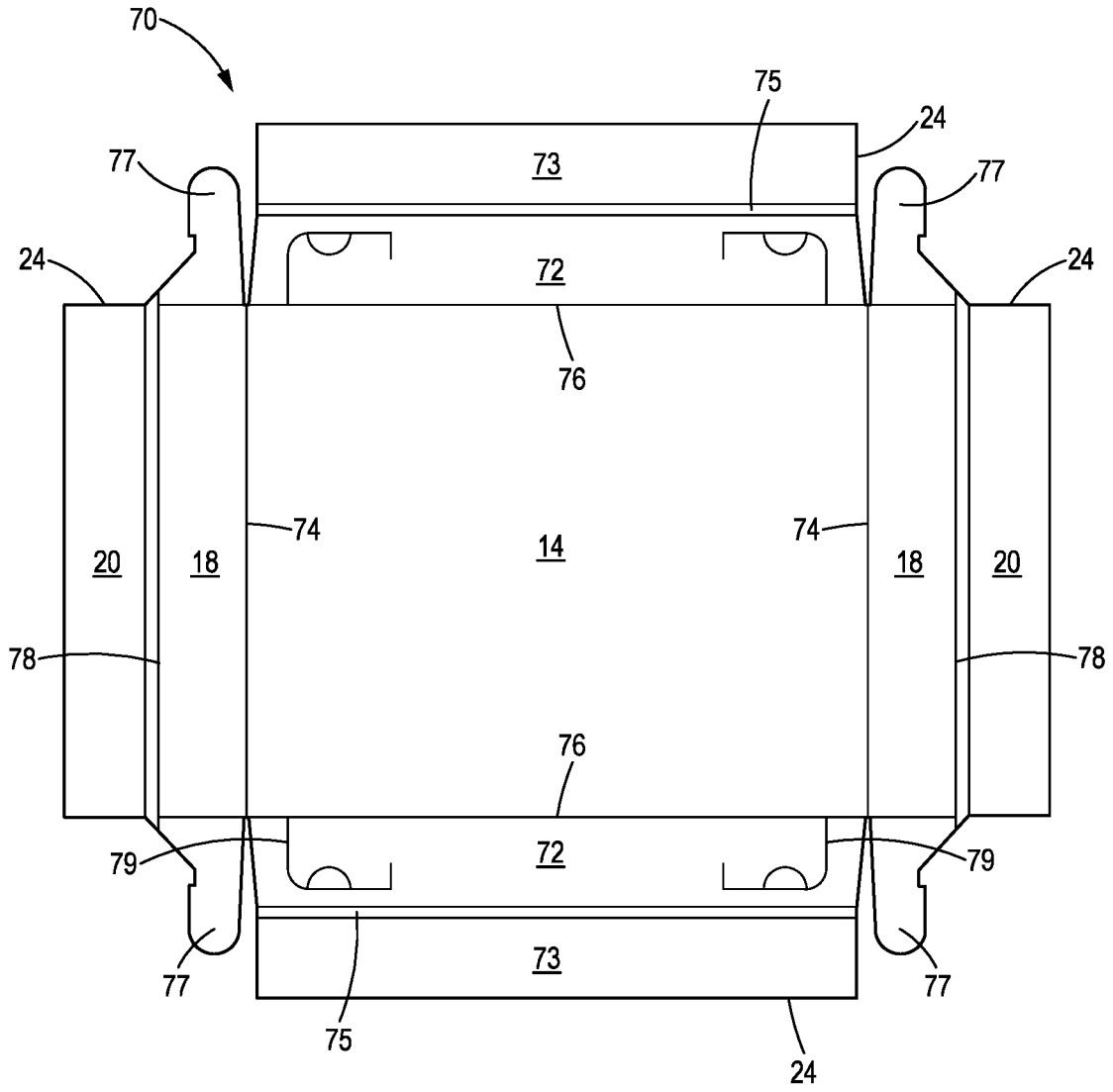
FIG. 4 is a top plan view of a blank used to make a top cap of the kind used as a component of the packaging assembly of FIG. 1.

FIG. 4 is a top plan view of a top cap blank 70 used to make a top cap 12 of the kind used as a component of the packaging assembly 10 of FIG. 1. The top cap blank 70 may comprise a top panel 14 defined by side fold lines 74 and end fold lines 76, the width and depth of the top panel 14 being determined by the dimensions of the appliance 100 to be packaged. Left and right side outer flaps 18 are foldably connected to the top panel 14 along the side fold lines 74. Left and right side inner flaps 20 are foldably connected to the outer flaps 18 along double fold lines 78. Similarly, front and rear outer panels 72 are foldably connected to the top panel 14 along the end fold lines 76. Front and rear inner panels 73 are foldably connected to the front and rear outer panels 72 along double fold lines 75.

Optionally, tabs 77 may extend from the ends of each outer flap 18. Each of the front and rear outer panels 72 may define slots 79 configured to receive tabs 77 in the assembled top cap 12.

Figure 5:
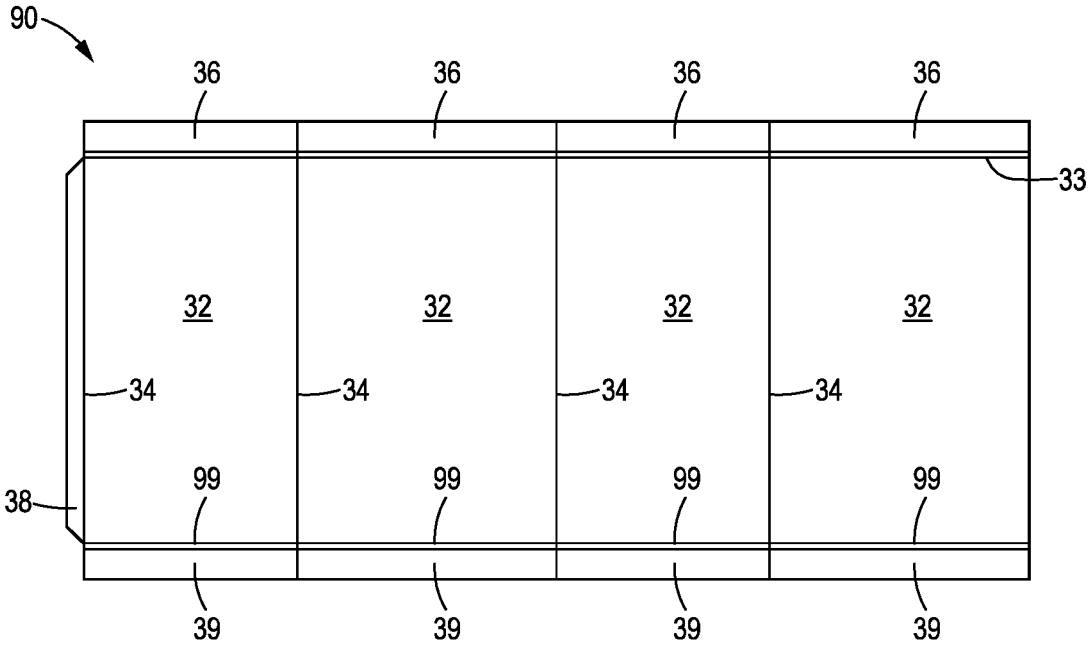
FIG. 5 is a top plan view of a blank used to make a carton of the kind used as a component of the packaging assembly of FIG. 1.

FIG. 5 is a top plan view of a carton blank 90 used to make a carton 30 of the kind used as a component of the packaging assembly of FIG. 1. The carton blank 90 may be made of corrugated fiberboard or other suitable material that, when assembled, forms an open-ended rectangular prism having vertically extending, rectangular sidewalls 32 joined together at vertical fold lines 34. To close off the carton 30, a short glue flap 38 extends from a sidewall 32 to underlie the edge of another sidewall 32 to which it is glued to hold the carton 30 in the closed position. Optionally, a small bottom flap 39 is foldably attached to the bottom edge 99 of each sidewall 32. An top flap 36 is foldably attached to the top edge 33 of each sidewall 32. Both the bottom edges 99 and the top edges 33 may be single or, preferably, double fold lines to allow for a 180 degree fold.

Figure 6:
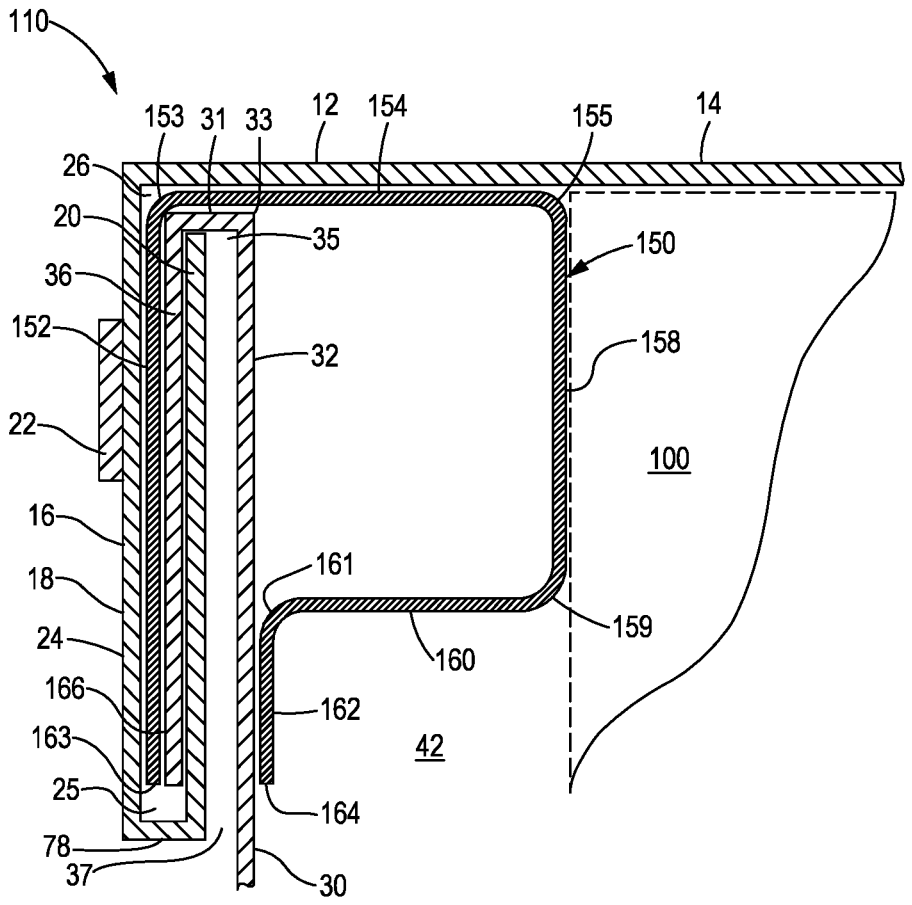
FIG. 6 is a partial cross-sectional view of a second embodiment of a packaging assembly for housing an appliance or other item.

FIG. 6 is a partial cross-sectional view of a second embodiment of a packaging assembly 110 for housing an appliance 100 or other item. The packaging assembly 110 is similar to the first embodiment in that it comprises a top cap 12, a carton 30 and a spacer 150. The top cap 12 and the carton 30 may be similar to or even the same as the top cap 12 carton 30 of the first embodiment.

The top cap 12 fits over the carton 30 and comprises a top (covering) panel 14 and four downwardly extending side flaps 24. At least one of the side flaps 24 also functions as a (basiloid) lifting flange 16. The lifting flange 16 comprises an outer flap 18 extending downwardly from the top panel 14 and an inner flap 20 extending upwardly from the outer flap 18. The outer flap 18 and the inner flap 20 define a first slot 25 having an open upper, top panel facing end 26, the purpose of which is explain below.

The carton 30 has four sidewalls 32 foldably attached to each other along vertical fold lines 34 to form a rectilinear sleeve-like structure. A top flap 36 extends downward from the top edge 33 of at least one sidewall 32. The top flap 36 is connected to the top edge 33 by a relatively short top lip 31. The top flap 36 extends downward into the first slot 25.

The sidewall 32 and the top flap 36 define a second slot 35 having an open lower end 37 for receiving the top cap inner flap 20. As best shown in FIG. 3 with respect to the first embodiment, the top cap inner flap 20 and the carton sidewall 32 are flexible enough or the second slot 35 is wide enough to also accommodate a basiloid blade 40. More particularly, a basiloid blade 40 can be inserted into the second slot 35 between the top cap inner flap 20 and the carton sidewall 32.

Like the spacer 50 of the first embodiment, the alternative spacer 150 is frictionally attached to the carton 30 and is at least partially located within the carton 30 to space the appliance 100 from the inside of a carton wall 32 to cushion and protect the C appliance 100 during basiloid handling, especially near the top of the packaging assembly 110.

The spacer 150 comprises a substantially planar outer leg panel 152 extending upward from the elongated first free edge 163 to an upper edge 153, a top panel 154 oriented orthogonally to the outer leg panel 152 and extending from the upper edge 153 to a second upper edge 155, an appliance facing panel 158 extending vertically downward from the second upper edge 155 to an inner edge 159, a lower horizontal panel 160 extending horizontally outward (away from the appliance) from the inner edge 159 to a third edge 161 adjacent the sidewall 32, and an inner leg panel 162 extending vertically downward from the lower horizontal panel 160 to a second free edge 164. The outer leg panel 152 and the inner leg panel 162 are in generally parallel spaced relation to each other to form an open lower slot 166 for receiving the carton 30.

Figure 7:
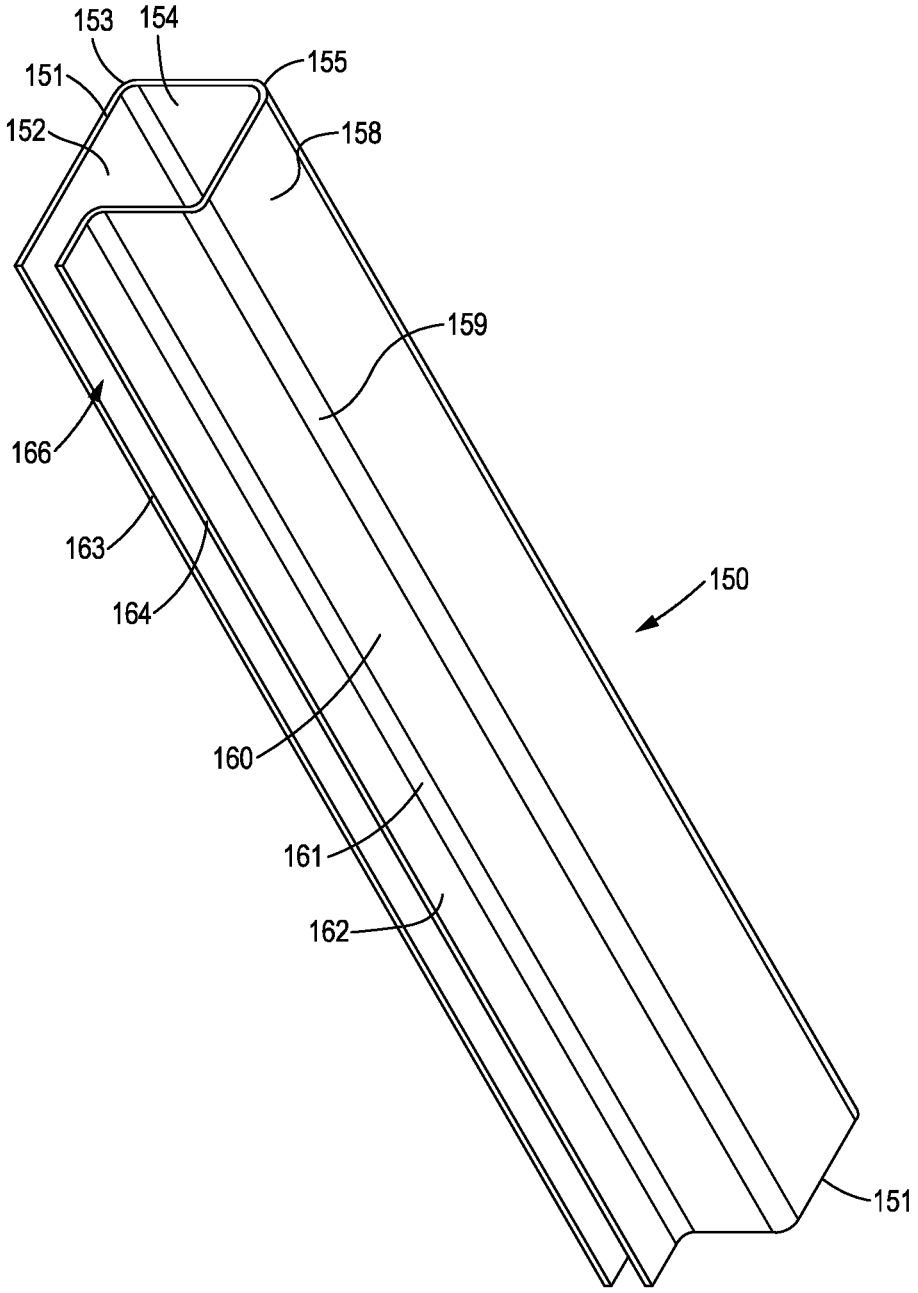
FIG. 7 is a perspective view of a spacer used as a component of the packaging assembly of FIG. 6.

As perhaps best shown in FIG. 7, the spacer 150 has opposing horizontal ends 151, an elongated first free edge 163 and an elongated second free edge 164. The spacer 150 may be made from a rectangular sheet of material such as paperboard that has been folded or otherwise shaped into a modified "P" shape that enables the spacer 150 to fit snugly over the carton 30 and part of the top cap 12 to separate the appliance 100 and the carton 30. The "P" shape also enhances the structural strength of the packaging assembly 110.

The spacer 150 may be substantially rigid, especially in the longitudinal (end 151 to end 151) direction, yet resiliently flexible in the transverse direction (defined as the direction orthogonal to the longitudinal direction), at least prior to installation, partly due to the fact that the spacer 150 is open along lower slot 166. When installed, the spacer 150 maintains a gap between the appliance 100 and the carton sidewall 32 a distance approximately equal to the length of the lower horizontal panel 160.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

The invention claimed is:

1. A packaging assembly for housing an item, the packaging assembly comprising:

a top cap having a top panel, an outer flap and an inner flap, the outer flap and the inner flap forming part of a basiloid lifting flange, the outer flap extending downward from the top panel and terminating in a fold line, the inner flap extending upwardly from the fold line, the outer flap and the inner flap defining a first slot having a top panel facing upper end;

a carton defining a carton interior and comprising four sidewalls foldably attached along vertical fold lines to form a rectilinear structure, each sidewall having a top edge, the carton further comprising a top flap extending downward from the top edge of at least one of the four sidewalls, the top flap extending into the first slot, the at least one of the four sidewalls and the top flap defining a second slot having an open lower end for receiving the inner flap; and a spacer for spacing the item from the at least one of the four sidewalls and enhancing structural strength of the lifting flange, the spacer forming a frictional fit with the inner flap of the lifting flange and the at least n of the four sidewalls; wherein the second slot is configured to receive a blade of a basiloid lift truck to facilitate lifting and moving of the packaging assembly with the item contained therein by the basiloid lift truck.

2. The packaging assembly of claim 1, wherein:

the spacer is an elongated structure having opposing ends, an elongated first free edge and an elongated second edge.

3. The packaging assembly of claim 2, wherein the spacer comprises:

a substantially planar outer leg panel extending upward from the elongated first free edge to an upper edge;

a top panel oriented orthogonally to the outer leg panel and extending from the upper edge to a second upper edge;

an angled panel defining an obtuse included angle with the top panel and extending from the second upper edge to an inner edge;

an item facing panel extending vertically downward from the inner edge to a second inner edge;

a lower horizontal panel extending horizontally outward from the second inner edge to the sidewall; and an inner leg panel extending vertically downward from the lower horizontal panel to the elongated second free edge; wherein the outer leg panel and the inner leg panel are in a generally parallel spaced relation to each other and form an open lower slot for receiving the top flap, the inner flap and the carton sidewall.

4. The packaging assembly of claim 3 wherein:

the second slot is configured to receive a blade of a basiloid lift truck to facilitate lifting and moving of the packaging assembly with the item contained therein by the basiloid lift truck.

5. The packaging assembly of claim 2, wherein the spacer comprises:

a substantially planar outer leg panel extending upward from the elongated first free edge to an upper edge;

a top panel oriented orthogonally to the outer leg panel and extending from the upper edge to a second upper edge;

an item facing panel extending vertically downward from the second upper edge to an inner edge;

a lower horizontal panel extending horizontally outward from the inner edge to a third edge adjacent the sidewall; and an inner leg panel extending vertically downward from the lower horizontal panel to the second free edge; wherein the outer leg panel and the inner leg panel are in generally parallel spaced relation to each other to form an open lower slot for receiving the carton.

6. The packaging assembly of claim 5 wherein:

the second slot is configured to receive a blade of a basiloid lift truck to facilitate lifting and moving of the packaging assembly with the item contained therein by the basiloid lift truck.

7. The packaging assembly of claim 1, wherein:

the spacer is made from a rectangular sheet of material that has been shaped into a modified P shape.

8. The packaging assembly of claim 7, wherein:

the material is paperboard.

9. The packaging assembly of claim 1 wherein:

the spacer is located within the carton interior.

10. The packaging assembly of claim 2 wherein:

the spacer is substantially rigid in a longitudinal direction that extends from one of the opposing ends to the other of the opposing ends.

11. The packaging assembly of claim 10 wherein:

the spacer, prior to installation, is resiliently flexible in a transverse direction that is orthogonal to the longitudinal direction.

12. The packaging assembly of claim 1 wherein:

the spacer, when installed, maintains a gap between the item and the at least one of the four sidewalls a distance approximately equal to a length of a lower horizontal panel of the spacer.

13. A spacer for use with a basiloid package, the spacer comprising:

a substantially planar outer leg panel extending upward from a first elongated free edge to an upper edge;

a top panel oriented orthogonally to the outer leg panel and extending from the upper edge to a second upper edge;

an item facing panel extending vertically downward from the second upper edge to an inner edge;

a lower horizontal panel extending horizontally outward from the inner edge to a third edge; and an inner leg panel extending vertically downward from the lower horizontal panel to a second free edge; wherein the outer leg panel and the inner leg panel are in generally parallel spaced relation to each other to form an open lower slot configured to receive a carton.

14. The spacer of claim 13 wherein:

the spacer is an elongated structure having opposing ends.

15. The spacer of claim 14 wherein:

the spacer is made from a rectangular sheet of material that has been shaped into a modified P shape.

16. The spacer of claim 15, wherein:

the material is paperboard.

17. The spacer of claim 14, wherein:

the spacer is substantially rigid in a longitudinal direction that extends from one of the opposing ends to the other of the opposing ends.

18. The spacer of claim 17, wherein:

the spacer is resiliently flexible in a transverse direction that is orthogonal to the longitudinal direction.

* * * * *